US006619521B2

(12) United States Patent
Hadley

(10) Patent No.: US 6,619,521 B2
(45) **Date of Patent: *Sep. 16, 2003**

(54) UMBRELLA SUPPORT APPARATUS

(76) Inventor: Ronnie Hadley, 317 Adabell Rd., Atmore, AL (US) 36502

( * ) Notice: Subject to any disclaimer, the term of this patent is extended or adjusted under 35 U.S.C. 154(b) by 116 days.

This patent is subject to a terminal disclaimer.

(21) Appl. No.: 09/967,251

(22) Filed: Oct. 1, 2001

(65) Prior Publication Data

US 2003/0062072 A1 Apr. 3, 2003

(51) Int. Cl.[7] ..... A45B 11/02

(52) U.S. Cl. ..... 224/190; 224/251; 224/631; 224/637; 135/16

(58) Field of Search ..... 224/581, 186, 224/188, 189, 190, 628, 631, 637, 251, 259, 915; 135/15.1, 16, 90, 96, 98; 248/535, 539, 540; D3/5, 10

(56) References Cited

U.S. PATENT DOCUMENTS

| | | | | | |
|---|---|---|---|---|---|
| 507,481 | A | * | 10/1893 | Brooks | 224/190 |
| 595,218 | A | * | 12/1897 | Stauffer | 224/186 |
| 603,964 | A | * | 5/1898 | Northrup | 224/190 |
| 877,802 | A | * | 1/1908 | Shuster | 224/188 |
| 903,682 | A | * | 11/1908 | Cumpston | 224/190 |
| 921,900 | A | * | 5/1909 | Shuster | 224/190 |
| 1,181,491 | A | * | 5/1916 | Sutcliffe | 403/93 |
| 1,347,540 | A | * | 7/1920 | Godard | 224/190 |
| 1,399,683 | A | * | 12/1921 | Beavers | 224/190 |
| 1,704,407 | A | * | 3/1929 | Rice | 224/190 |
| 2,223,253 | A | * | 11/1940 | Hamilton | 224/189 |
| 3,204,650 | A | * | 9/1965 | Shinew | 135/16 |
| 4,188,965 | A | * | 2/1980 | Morman | 135/16 |
| 5,263,837 | A | * | 11/1993 | Dompe | 224/190 |
| 6,024,464 | A | * | 2/2000 | De Vera | 362/102 |
| 6,102,479 | A | * | 8/2000 | Wallace | 297/357 |

* cited by examiner

*Primary Examiner*—Stephen K. Cronin
(74) *Attorney, Agent, or Firm*—George A. Bode; Lisa D. Velez; Bode & Associates

(57) ABSTRACT

An umbrella supporting apparatus comprising a harness having shoulder straps, a waistband and a back-mounted umbrella support assembly which allows the canopy of the umbrella to be adjusted in two different planes. The back-mounted umbrella support assembly includes a support plate mounted to the waistband and has a plurality of spaced key holes defining a first set of vertically displace positions or angles. The assembly also includes a rotatable support bracket rotatably mounted to the support plate and a hollow rod coupled to the rotatable support bracket for supporting a shaft or pole of an umbrella. A locking lever is resiliently coupled to the rotatably support bracket. In operation, the rotatable support bracket is adapted to be rotated left or right and locked or secured to one of the spaced key holes via the locking lever to vertically offset the hollow rod from vertically upright or align the hollow rod vertically upright. The rotatable support bracket also has coupled thereto a pivot wheel for rotating the hollow rod backward or forward.

13 Claims, 3 Drawing Sheets

UMBRELLA SUPPORT APPARATUS

BACKGROUND OF THE INVENTION

1. Field of the Invention

The present invention relates to supporting devices for umbrellas and, more particularly, to an umbrella support apparatus which allows the umbrella to be adjusted in two separate planes perpendicular to each other.

2. General Background

Especially during intense heat, outside workers, such as, policemen, gardeners, roofers, etc., are constantly bothered by the suns rays. Not only does the sun increase the ambient temperature, but also creates rays which can obscure the sight of the workers. It is has been well established that umbrellas can shade a user from sun rays. However, beach umbrellas are typically very large and not easily transportable as the worker performs their duties. On the other hand, hand-held umbrellas can be used to shade a worker but occupies their hands so that work can not be accomplished.

Several apparatuses have been patented which are aimed at supporting devices for umbrellas.

U.S. Pat. No. 903,682 issued to F. B. Cumpston, entitled "SUPPORTING DEVICE FOR UMBRELLAS," discloses a supporting device for an umbrella comprising an adjustable belt which supports a harness from the waist of the user. The harness has attached thereto a carrier plate and a yoke plate for carrying a hollow rotatable tubular arm which in turn carries an umbrella. The tubular arm is adapted to be angular displaced via a pair of cup and ball arrangements so that the angle of the umbrella can be selected by the user.

Similarly, U.S. Pat. No. 1,704,407 issued to Rice, entitled "UMBRELLA SUPPORT," discloses an umbrella support which includes harness supporting a back plate and curved sleeve coupled to a ball adjustable secured in the socket by a bolt and nut connection.

U.S. Pat. No. 4,188,965 issued to J. W. Morman, entitled "BODY MOUNTED UMBRELLA," discloses an umbrella attached to the body of the user via an adjustable belt. The umbrella is supported in a vertical post which includes a pivot to allow the umbrella to be pivoted from an upright position to a displaced position.

U.S. Pat. No. 5,887,771 issued to D. J. Perry, entitled "BACK SUPPORTED UMBRELLA HOLDER," discloses a supporting device for an umbrella which includes a frame and straps for securing the device to the back of the user. The umbrella is stored in an umbrella support receptacle of the device. In one embodiment, the supporting device includes a tilt mechanism which permits angular adjustment of the umbrella support receptacle.

U.S. Pat. No. 5,263,837 issued to Dompe, entitled !"PERSONAL UMBRELLA SUPPORT," discloses a device which includes a plate supported about the back of the user via a harness. The umbrella is supported in a cup which is adapted to be pivoted. A clamp is provided above the cup to support a tube holding the umbrella stem.

Other patent in the art include U.S. Pat. No. 191,782 issued to B. B. Smith, Sr., entitled "UMBRELLA-SUPPORT"; U.S. Pat. No. 1,020,666 issued to T. Simard, entitled "BODY HARNESS AND UMBRELLA SUPPORT"; and, U.S. Pat. No. 2,926,826 issued to W. Conrad, entitled "ADJUSTABLE UMBRELLA HOLDER", all of which disclose a supporting device for an umbrella that has a belt and/or harness and carrying means for carrying the umbrella in the front of the user.

SUMMARY OF THE PRESENT INVENTION

The preferred embodiment of umbrella support apparatus of the present invention solves the aforementioned problems in a straight forward and simple manner.

Broadly, the present invention contemplates an umbrella supporting apparatus comprising a back-mounted umbrella support assembly which is adapted to be secured about the back of the user which allows the canopy of the umbrella to be adjusted in two different planes. The back-mounted umbrella support assembly includes a support plate mounted to the waistband and has a plurality of spaced key holes defining a first set of vertically displace positions or angles. The assembly also includes a rotatable support bracket rotatably mounted to the support plate and a hollow rod coupled to the rotatable support bracket for supporting a shaft or pole of an umbrella. A locking lever is resiliently coupled to the rotatably support bracket. The rotatable support bracket also has coupled thereto a pivot wheel for rotating the hollow rod backward or forward.

In operation, the rotatable support bracket is adapted to be rotated left or right and locked or secured to one of the spaced key holes via the locking lever to vertically offset the hollow rod from vertically upright or align the hollow rod vertically upright. Additionally, the hollow rod can be pivoted backward or forward via the pivot wheel.

In view of the above, a feature of the present invention is to provide an umbrella support apparatus which is simple to use.

Another feature of the present invention is to provide an umbrella support apparatus which is relatively simple structurally and thus simple to manufacture.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
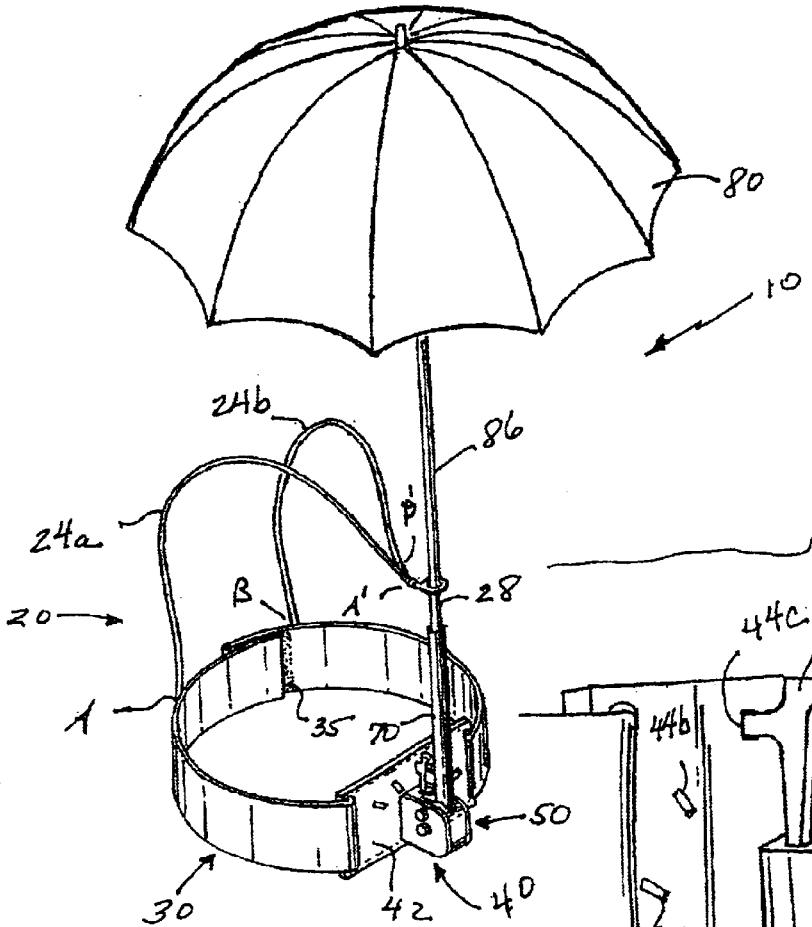
FIG. 1 illustrates a perspective view of the umbrella support apparatus of the present invention.
Figure 2:
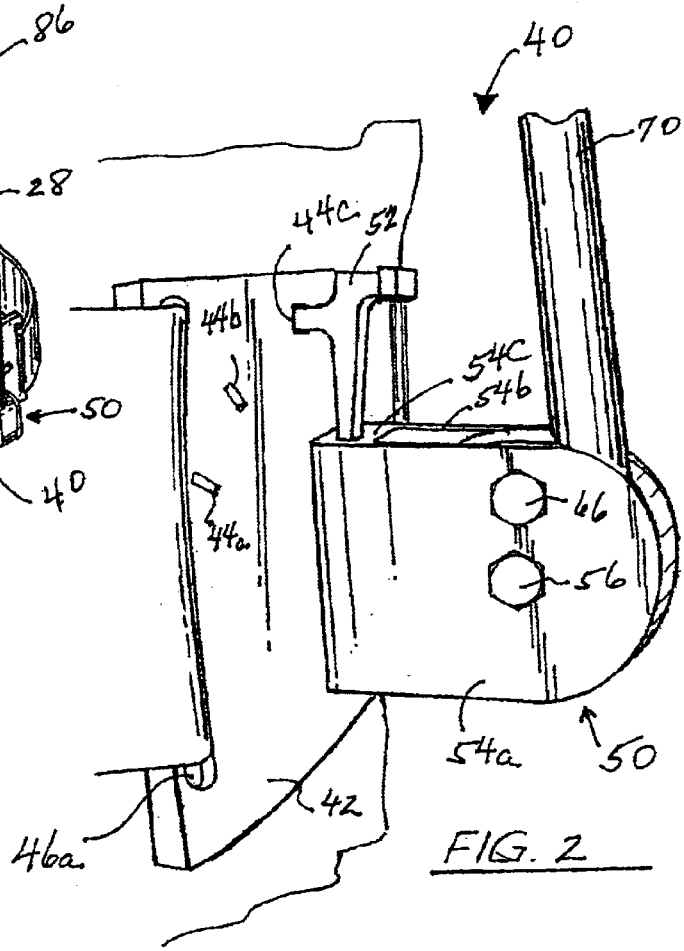
FIG. 2 illustrates a side view of the back-mounted umbrella or parasol support assembly of the present invention.
Figure 3:
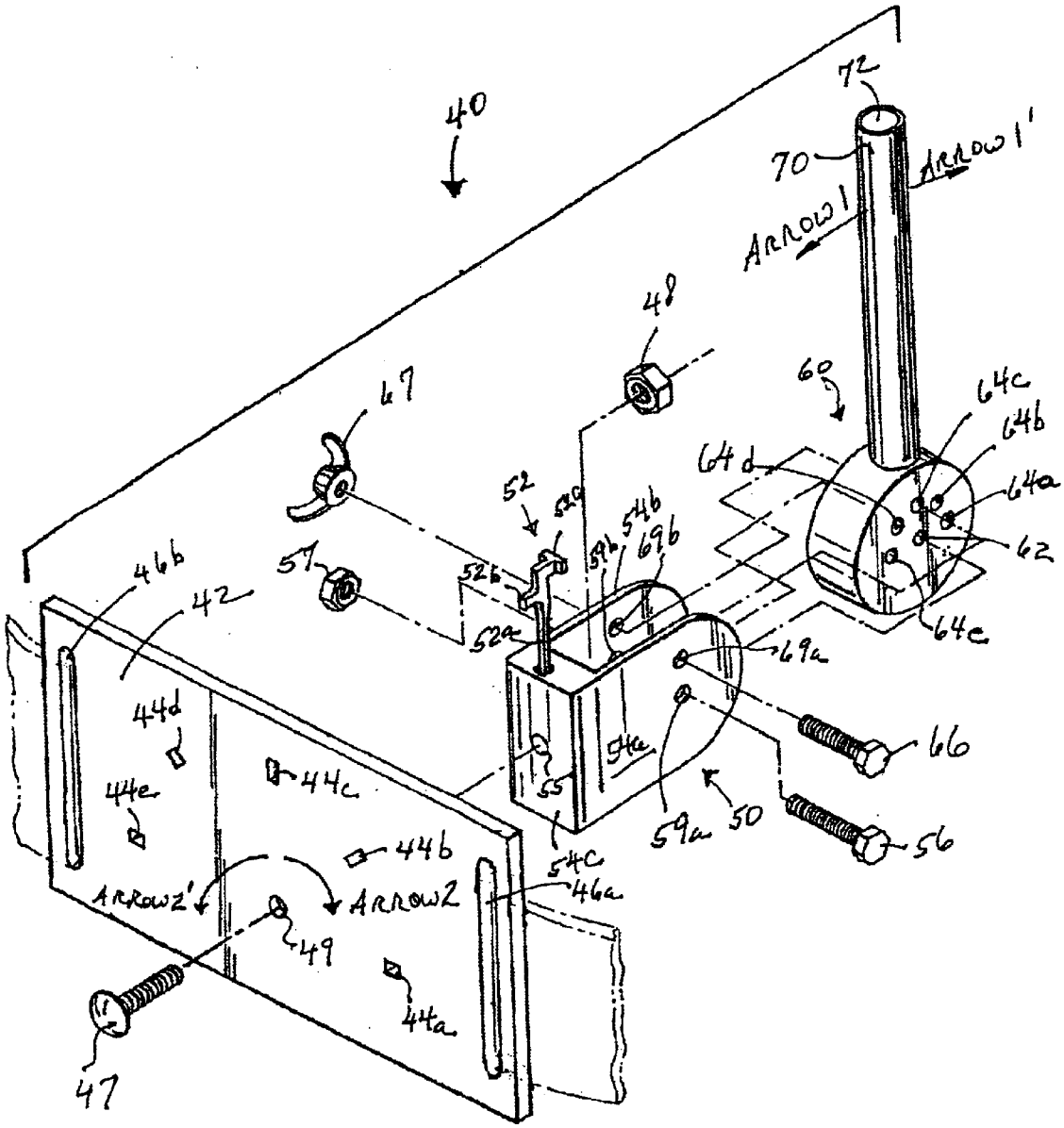
FIG. 3 illustrates an exploded view of the back-mounted umbrella or parasol support assembly of the present invention.

Referring now to the drawings and in particular FIGS. 1–3, the umbrella support apparatus of the present invention is generally referenced by the numeral 10. The umbrella or parasol 80 includes a canopy 84 coupled to a top end of a pole or shaft 86. The other end of the pole or shaft 86 typically includes a handle (NOT SHOWN). The apparatus 10 is generally comprised of a harness 20 supported about the waist of a user 5 by a waistband 30 and a back-mounted umbrella or parasol support assembly 40. The pole or shaft 86 of the umbrella or parasol 80 is adjustably coupled to the waistband 30 via the back-mounted umbrella or parasol support assembly 40.

Figure 4:
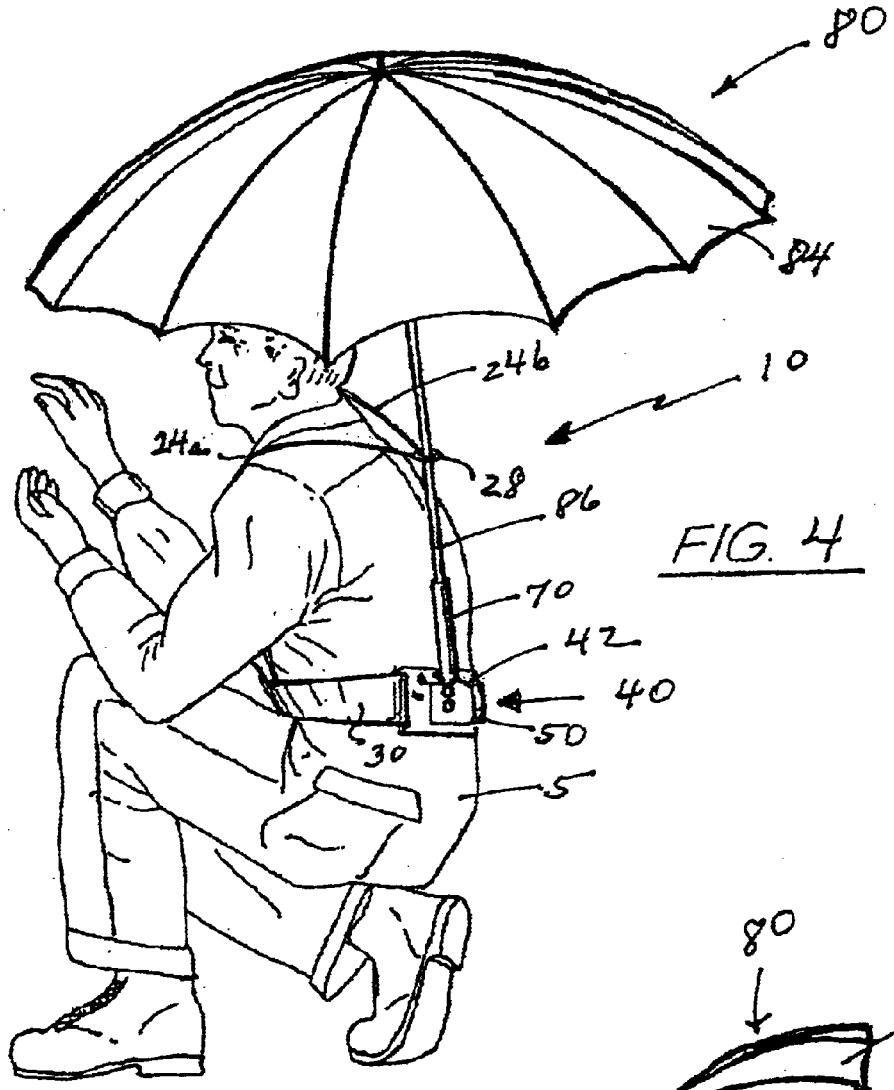
FIG. 4 illustrates a perspective view of the umbrella support apparatus of the present invention attached to the user wherein the user is in a stooping position; and, FIG. 5 illustrates a perspective view of the umbrella support apparatus of the present invention attached to the user wherein the user is in a kneeling position.
Figure 5:
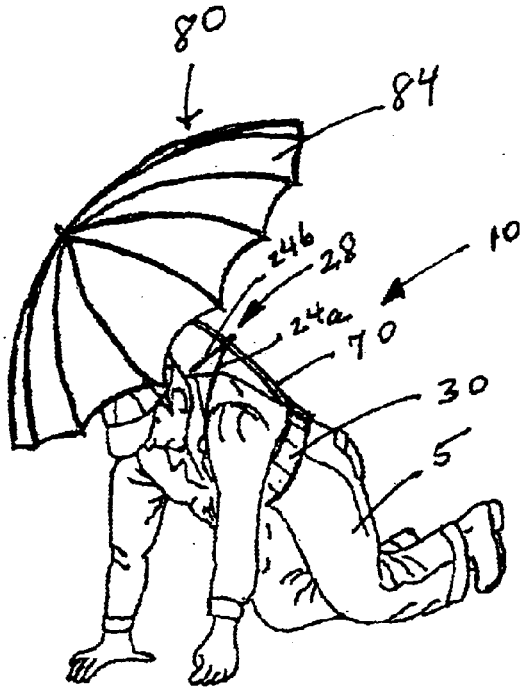

The harness 20 includes shoulder straps 24*a* and 24*b* each of which has one free end A and B, respectively, fastened to the front of the waistband 30 and the other free end A' and B', respectively, tethered to the umbrella's pole or shaft 86 via a slidable ring 28. Thereby, as the user 5 moves, bends, stoops or kneels, as best seen in FIGS. 4 and 5, the slidable ring 28 moves along the pole or shaft 86 so that the umbrella or parasol canopy 84 tracks the movements of the user 5. Additionally, the pole or shaft 86 is kept relatively close to the back of the user 5 via such tethered connection, as the user 5 moves.

The waistband 30 is secured about the waist of the user 5 via a fastener device 35. In the exemplary embodiment, the fastener device 35 includes mated hook and loop fasteners, such as VELCRO, for snugly fitting the waistband 30 about the waist of user 5. Nevertheless, other fastening devices may be used such as, without limitation, a buckle.

As best seen in FIGS. 2 and 3, the back-mounted umbrella or parasol support assembly 40 includes a support plate 42 mounted substantially in the center of the waistband 30 or at a position which locates the support plate 40 about the center of the lower back of the user 5. The support plate 42 includes side slots 46*a* and 46*b* on opposite sides of the support plate 42 for receiving the waistband 30 therethrough. Thus, the support plate 42 can be slidably adjusted along the waistband 30 so that it is located about the center of the lower back. Furthermore, the support plate 42 has formed therein a plurality of spaced key holes 44*a*, 44*b*, 44*c*, 44*d* and 44*e*.

The back-mounted umbrella or parasol support assembly 40 further includes a rotatable support bracket 50 rotatably mounted to the support plate 42 and a locking lever 52 wherein the rotatable support bracket 50 is adapted to be locked or secured to one of the spaced key holes 44*a*, 44*b*, 44*c*, 44*d* and 44*e* via locking lever 52, such as, without limitation, by friction fit coupling.

A hollow rod 70 is coupled to rotatable support bracket 50 and can be rotated left and/or right, in the direction of ARROWS 2 and 2', to one of a first set of vertically displaced positions or angles from vertically upright defined by the spaced key holes 44*a*, 44*b*, 44*d* and 44*e* via the rotatable support bracket 50 and locked thereto via the locking lever 52 wherein key hole 44*c* essentially aligns the hollow rod 70 vertically upright. In the exemplary embodiment, the spaced key holes 44*a*, 44*b*, 44*c*, 44*d* and 44*e* are aligned along an arc or a semi-circle.

The rotatable support bracket 50 includes two parallel side walls 54*a* and 54*b* and a back wall 54*c* perpendicular to the side walls 54*a* and 54*b*. The back wall 54*c* is rotatably mounted to the support plate 42 via bolt 47 and nut 48 fasteners. Both the back wall 54*c* and the support plate 42 have holes or apertures 55 and 49, respectively, formed therein for receiving the bolt 47.

The back-mounted umbrella or parasol support assembly 40 also includes a pivot wheel 60 supported by rotatable support bracket 50 between the two parallel side walls 54*a* and 54*b* thereof wherein the hollow rod 70 depends upwardly from the pivot wheel 60. The pivot wheel 60 has formed therein a center-hole 62 and a plurality of spaced displacement-holes 64*a*, 64*b*, 64*c* and 64*d* aligned in an arc or a semi-circle about the center-hole 62. The center-hole 62 defines the primary pivot axis for rotating the hollow rod 70 and is secured to side walls 54*a* and 54*b* via bolt 56 and nut 57 fasteners through aligned holes 59*a* and 59*b*. The pivot wheel 60 pivots about bolt 56 to rotate the hollow rod 70, depending upwardly therefrom, in the direction of ARROWS 1 and 1' when it is unlocked or unsecured via the bolt 66 and wingnut 67 fasteners secured in one of the plurality of spaced displacement-holes 64*a*, 64*b*, 64*c* and 64*d* and holes 69*a* and 69*b* of sidewalls 54*a* and 54*b*, respectively. In other words, the hollow rod 70 can be rotated forward and/or backward to one of a second set of vertically displaced positions or angles. The second set of vertically displaced positions or angles is in a plane perpendicular to a plane of the first set of vertically displaced positions or angles.

The locking lever 52 includes a resiliently mounted lever arm 52*a* coupled to the back wall 54*c* of the rotatable support bracket 50 and a projection 52*b* dimensioned to be fit and secured in the spaced key holes 44*a*, 44*b*, 44*c*, 44*d* and 44*e*. The locking lever 52 further includes a handle 52*c* positioned at the top of the lever arm 52*a* to remove or insert the projection 52*b* from or in any one of the spaced key holes 44*a*, 44*b*, 44*c*, 44*d* and 44*e*. Thereafter, the rotatable support bracket 50 can be rotated to another position of the first et of vertically displaced positions or angles secured thereto by inserting the projection 52*b* into one of the spaced key holes 44*a*, 44*b*, 44*c*, 44*d* and 44*e*.

The hollow rod 70 includes a bore 72 of a diameter sufficient to accept the pole or shaft 86 or, alternately, a handle of the umbrella or parasol 80. Nevertheless, the hollow rod 70 may be integral with the pole or shaft 86 or handle of the umbrella or parasol 80.

In operation, the user 5 fastens waistband 30 around their waist and fastens the shoulder straps 24*a* and 24*b* over their shoulders. Thereafter, the pole or shaft 86 or handle of umbrella or parasol 80 is inserted into bore 72 of the hollow rod 70. Finally, the user 5 can tilt the canopy 84 to a desired angle by loosening nut and bolt fastener 66, 67, rotating pivot wheel 60 to the desired position or angle in the direction of ARROWS 1 and 1' and again tightening nut and bolt fastener 66, 67. Furthermore, the user 5 can tilt the canopy 84 to a desired position or angle by un-securing or unlocking the locking lever 52 from one of the spaced key holes 44*a*, 44*b*, 44*c*, 44*d* and 44*e*, rotating the rotatable support bracket 50 in the direction of ARROWS 2 and 2' and, thereafter, locking the locking lever 52 into one of the spaced key holes 44*a*, 44*b*, 44*c*, 44*d* and 44*e*. Thus, the canopy 84 can be manipulated in a variety of direction to block the sunlight.

As can be appreciated, the apparatus 10 can be used in many scenarios—by a prison guard on horseback; by a farmer on his tractor; by a backyard gardener; by a roofer on a red hot roof; etc. In each scenario, the user 5 can keep their hands free while obtaining shade by the umbrella or parasol 80 as they move about and as the direction of the sun changes.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An umbrella supporting apparatus comprising:

a harness having shoulder straps;

a waistband; and, a back-mounted umbrella support assembly which includes:

a support plate mounted to the waistband having formed therein a plurality of spaced key holes defining a first set of vertically displace positions or angles, a rotatable support bracket rotatably mounted to the support plate, a hollow rod coupled to the rotatable support bracket for supporting a shaft or pole of an umbrella, and a locking lever resiliently coupled to the rotatably support bracket wherein the rotatable support bracket is adapted to be rotated left or right and locked or secured to one of the spaced key holes via the locking lever to vertically offset the hollow rod from vertically upright or align the hollow rod vertically upright.

2. The apparatus of claim 1, wherein the rotatable support bracket includes:

two parallel side walls; and, a back wall perpendicular to the side walls wherein the back wall is rotatably mounted to the support plate and the locking lever is resiliently coupled to depend upward from the back wall.

3. The apparatus of claim 2, wherein the back-mounted umbrella support assembly further includes:

a pivot wheel supported by the rotatable support bracket between the two parallel side walls and having depending upward therefrom the hollow rod.

4. The apparatus of claim 3, wherein the pivot wheel has formed therein a center-hole and a plurality of spaced displacement-holes aligned in an arc or a semicircle about the center-hole, the center-hole defines a primary pivot axis for rotating the hollow rod thereby the hollow rod can be rotated forward and/or backward to one of a second set of vertically displaced positions or angles from vertically upright.

5. The apparatus of claim 1, wherein the locking lever includes:

a resiliently mounted lever arm coupled to the rotatable support bracket;

a projection dimensioned to be fit and secured in the spaced key holes; and, a handle positioned at a top of the lever arm to remove or insert the projection from or in any one of the spaced key holes.

6. The apparatus of claim 1, wherein the hollow rod includes a bore of a diameter sufficient to accept the pole or the shaft or, alternately, a handle of the umbrella.

7. The apparatus of claim 1, wherein the shoulder straps each include a first end fastened to the waistband and a second end tethered to the pole or the shaft of the umbrella via a ring, thus, as the user bends, the ring slides along the pole or the shaft.

8. An umbrella supporting apparatus comprising:

a harness having shoulder straps;

a waistband; and, a back-mounted umbrella support assembly which includes:

a support plate mounted to the waistband having formed therein a plurality of spaced key holes defining a first set of vertically displace positions or angles, a rotatable support bracket rotatably mounted to the support plate, a pivot wheel supported by the rotatable support bracket, a hollow rod depending upward from the pivot wheel for supporting a shaft or pole of an umbrella, and a locking lever resiliently coupled to the rotatably support bracket wherein the rotatable support bracket is adapted to be rotated left or right and locked or secured to one of the spaced key holes via the locking lever to vertically offset the hollow rod from vertically upright or align the hollow rod vertically upright.

9. The apparatus of claim 8, wherein the rotatable support bracket includes:

two parallel side walls; and, a back wall perpendicular to the side walls wherein the back wall is rotatably mounted to the support plate and the locking lever is resiliently coupled to depend upward from the back wall.

10. The apparatus of claim 9, wherein the pivot wheel has formed therein a center-hole and a plurality of spaced displacement-holes aligned in an arc or a semicircle about the center-hole, the center-hole defines a primary pivot axis for rotating the hollow rod thereby the hollow rod can be rotated forward and/or backward to one of a second set of vertically displaced positions or angles from vertically upright.

11. The apparatus of claim 8, wherein the locking lever includes:

a resiliently mounted lever arm coupled to the rotatable support bracket;

a projection dimensioned to be fit and secured in the spaced key holes; and, a handle positioned at a top of the lever arm to remove or insert the projection from or in any one of the spaced key holes.

12. The apparatus of claim 8, wherein the hollow rod includes a bore of a diameter sufficient to accept the pole or the shaft or, alternately, a handle of the umbrella.

13. The apparatus of claim 8, wherein the shoulder straps each include a first end fastened to the waistband and a second end tethered to the pole or the shaft of the umbrella via a ring, thus, as the user bends, the ring slides along the pole or the shaft.

* * * * *